United States Patent [19]

Fluester

[11] 4,147,047

[45] Apr. 3, 1979

[54] TOOL FOR SETTING THREADED BUSHES

[75] Inventor: James F. Fluester, Gillingham, England

[73] Assignee: Spiralux Limited, England

[21] Appl. No.: 855,665

[22] Filed: Nov. 29, 1977

[51] Int. Cl.[2] ..... B21J 15/34

[52] U.S. Cl. ..... 72/114; 72/391

[58] Field of Search ..... 72/391, 114; 29/243.52, 29/243.53, 243.54

[56] References Cited

U.S. PATENT DOCUMENTS

| | | | |
|---|---|---|---|
| 2,324,104 | 7/1943 | Moss | 72/391 |
| 2,358,703 | 9/1944 | Gookin | 72/391 |
| 2,430,563 | 11/1947 | Gill | 72/391 |
| 2,471,598 | 5/1949 | Wilt | 72/391 |
| 2,507,740 | 5/1950 | Tincler | 72/391 |
| 3,728,882 | 4/1973 | Rigot | 29/243.52 |
| 3,768,297 | 10/1973 | Martin | 72/391 |
| 3,933,019 | 1/1976 | Underland | 72/391 |
| 4,037,448 | 7/1977 | Di Maio | 72/391 |

FOREIGN PATENT DOCUMENTS

| | | | |
|---|---|---|---|
| 1140432 | 1/1956 | Fed. Rep. of Germany | 72/391 |
| 316518 | 7/1972 | U.S.S.R. | 72/391 |

*Primary Examiner*—C. W. Lanham
*Assistant Examiner*—Gene P. Crosby
*Attorney, Agent, or Firm*—Lane, Aitken & Ziems

[57] ABSTRACT

A tool for setting threaded bushes has a body portion and a mandrel puller rotatably and slidably mounted in the body portion. A mandrel is fixed to the mandrel puller for movement therewith. The free end portion of the mandrel is screw-threaded for engagement with a threaded bush. Means are provided for sliding the mandrel puller relative to the body portion so that the threaded bush strikes the body portion and is arrested thereby. Further movement of the mandrel puller causes the bush to expand and be set in position. The threaded bush is releasable from the mandrel by rotating the mandrel puller relative to the body portion.

12 Claims, 2 Drawing Figures

Fig.2

TOOL FOR SETTING THREADED BUSHES

BACKGROUND TO THE INVENTION

This invention relates to a tool for setting threaded bushes and to a method of setting threaded bushes.

Threaded bushes are used in many ways in all sorts of applications both in industry and in the "Do-it-Yourself" field. There are three basic types of threaded bush, each of which is of a generally cylindrical hollow configuration whose cylindrical internal surface is partially threaded, the non-threaded portion being expansible to anchor the bush in an aperture. This expansion is caused by screwing the bush onto a threaded mandrel and then pulling the mandrel whilst simultaneously preventing the bush from moving with the mandrel. The first type of threaded bush is intended for use with thin sheets of material such as metallic plates. Here, the unthreaded portion is designed to collapse radially outwardly so as to clench the bush tightly against the sheet. The second type is designed for apertures in thicker sheets and has a weakened portion intermediate its threaded and unthreaded portions. The end of the threaded portion is frustoconical so that it can be pulled into the unthreaded portion to expand the latter when the bush is fractured at its weakened portion. The third type of bush is intended for use in blind bores in even thicker materials, typically in such material as chip board. Here, the unthreaded portion is provided with axial slots so that this portion can expand radially outwardly in response to axial pressure.

Most tools for setting such threaded bores are expensive power tools and so not suitable for the "do-it-yourself" enthusiast. What hand tools are available suffer from the disadvantage that it is difficult to remove the mandrel from the set bush without dismantling the setting tool.

SUMMARY OF THE INVENTION

The present invention provides a tool for setting threaded bushes, the tool comprising a body portion, a mandrel puller rotatably and slidably mounted in the body portion, a mandrel fixed to the mandrel puller for rotational and sliding movement therewith, and means for sliding the mandrel relative to the body portion, the free end portion of the mandrel being screw-threaded for engagement with a threaded bush, the threaded bush being settable by sliding the mandrel puller relative to the body portion so that the threaded bush strikes the body portion, is arrested thereby, and is expanded upon further movement of the mandrel puller, and the threaded bush is releasable from the mandrel by rotation of the mandrel puller relative to the body portion.

Advantageously, the mandrel is fixed to the mandel puller by a screw-threaded engagement, and preferably, said screw-threaded engagement is left-handed. As the thread on the free-end portion of the mandrel is right-handed, this has the advantage that the rotational movement of the mandrel puller which releases the set bushes, tends to tighten the connection between the mandrel and its puller, thereby preventing the mandrel from working loose and dropping out of the tool.

The body portion may have a hollow, generally cylindrical nose into which the mandrel puller is a sliding fit, the mandrel puller also being generally cylindrical. Preferably, the nose is provided with a nose bush through which extends the free end portion of the mandrel. The nose bush may also be connected to the nose by means of a left-handed screw-threaded engagement. Again, this prevents the nose bush from being detached from the nose during release of the bushes.

Advantageously, a lever portion constitutes said means for sliding the mandrel puller relative to the body portion, the lever portion being pivoted to the body portion and being provided with means engaging the mandrel puller. Said means engaging the mandrel puller may be constituted by plug means which engage in an annular groove provided in the mandrel puller.

Preferably, both the body portion and the lever portion are provided with handles, the handles being spring biassed apart.

The invention also provides a method of setting threaded bushes, the method comprising the steps of screwing a threaded bush onto the screw-threaded free end portion of a mandrel which is fixed to a mandrel puller rotatably and slidably mounted in a body portion, pulling the mandrel puller so that it slides relative to the body portion whereby the threaded bush strikes the body portion, is arrested thereby, and is expanded upon further movement of the mandrel puller, and releasing the set threaded bush from the mandrel by rotating the mandrel puller relative to the body portion.

BRIEF DESCRIPTION OF DRAWINGS

A tool for setting threaded bushes and constructed in accordance with the invention will now be described, by way of example, with reference to the accompanying drawings, in which.

DESCRIPTION OF PREFERRED EMBODIMENT

Figure 1:
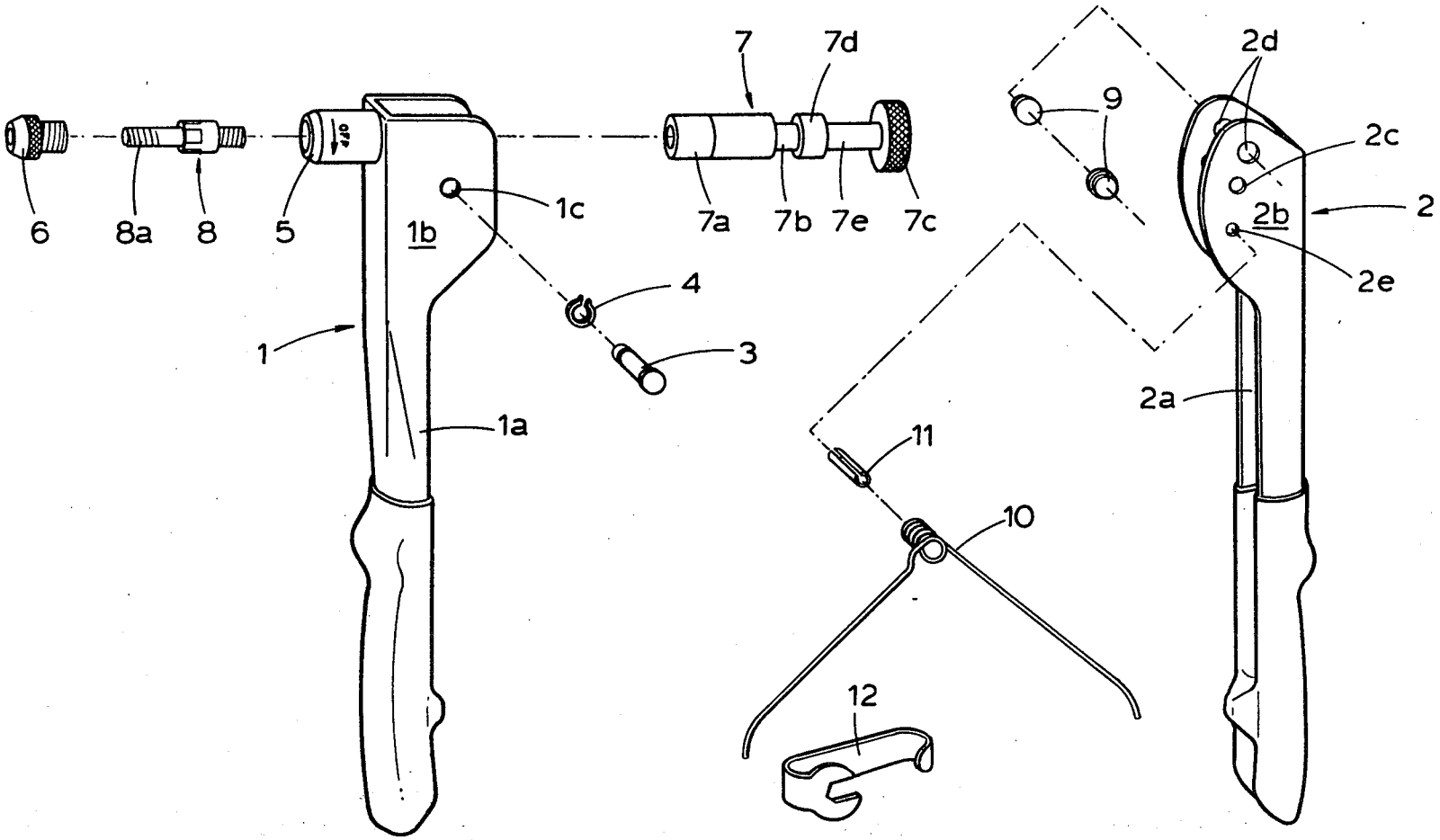
FIG. 1 is an exploded perspective view of the tool.

Referring to the drawings, the tool has a body unit 1 and a lever unit 2, both of which are made of sheet metal folded to form channel-like portions. The lower portion of the two units 1 and 2 define handles 1*a* and 2*a* and the upper portions define pairs of parallel flanges 1*b* and 2*b*. The two units 1 and 2 are pivoted together by means of a pivot pin 3 which passes through holes 1*c* and 2*c* respectively in their flanges 1*b* and 2*b*. A circlip 4 is provided to prevent the pivot pin slipping out of position.

A hollow nose 5 is fixed to the upper portion of the base unit 1 and a nose bush 6 having a left-hand thread 6*a* is screwed into a corresponding thread provided in the outer end of the nose. The cylindrical end portion 7*a* of a mandrel puller 7 is a sliding and rotatable fit within the inner end of the nose 5. A mandrel 8 (which may be any standard mandrel) is screwed with a left-hand thread into a correspondingly threaded axial bore in the end face of the portion 7*a* of the mandrel puller, the other end of the mandrel extending through the nose bush and being provided with a right-hand thread 8*a* corresponding to that of the bush to be set. In practice, the mandrel 8 must be screwed into position before the nose bush 6 is screwed into the nose 5.

The mandrel puller 7 has a portion 7*b* of reduced diameter and a knurled handle 7*c* joined to an intermediate portion 7*d* by a further reduced diameter portion 7*e*. The shoulders delimiting the portion 7*b* co-operate, in a manner described below, with pivot plugs 9 fixed in holes 2*d* in the flanges 2*b* of the lever unit 2. Thus, the mandrel puller 7 is held loosely within the telescoped flanges 1*b* and 2*b* in such a manner that it can rotate and in such a manner that it has a limited degree of axial play arising from the limited movement of the pivot plugs 9 as described below.

A spring 10 mounted on a tension pin 11 fixed in holes 2e in the flanges 2b of the lever unit 2, acts to bias the two handles 1a and 2a apart. When not in use a clamp 12 holds the handles 1a and 2a together.

Figure 2:
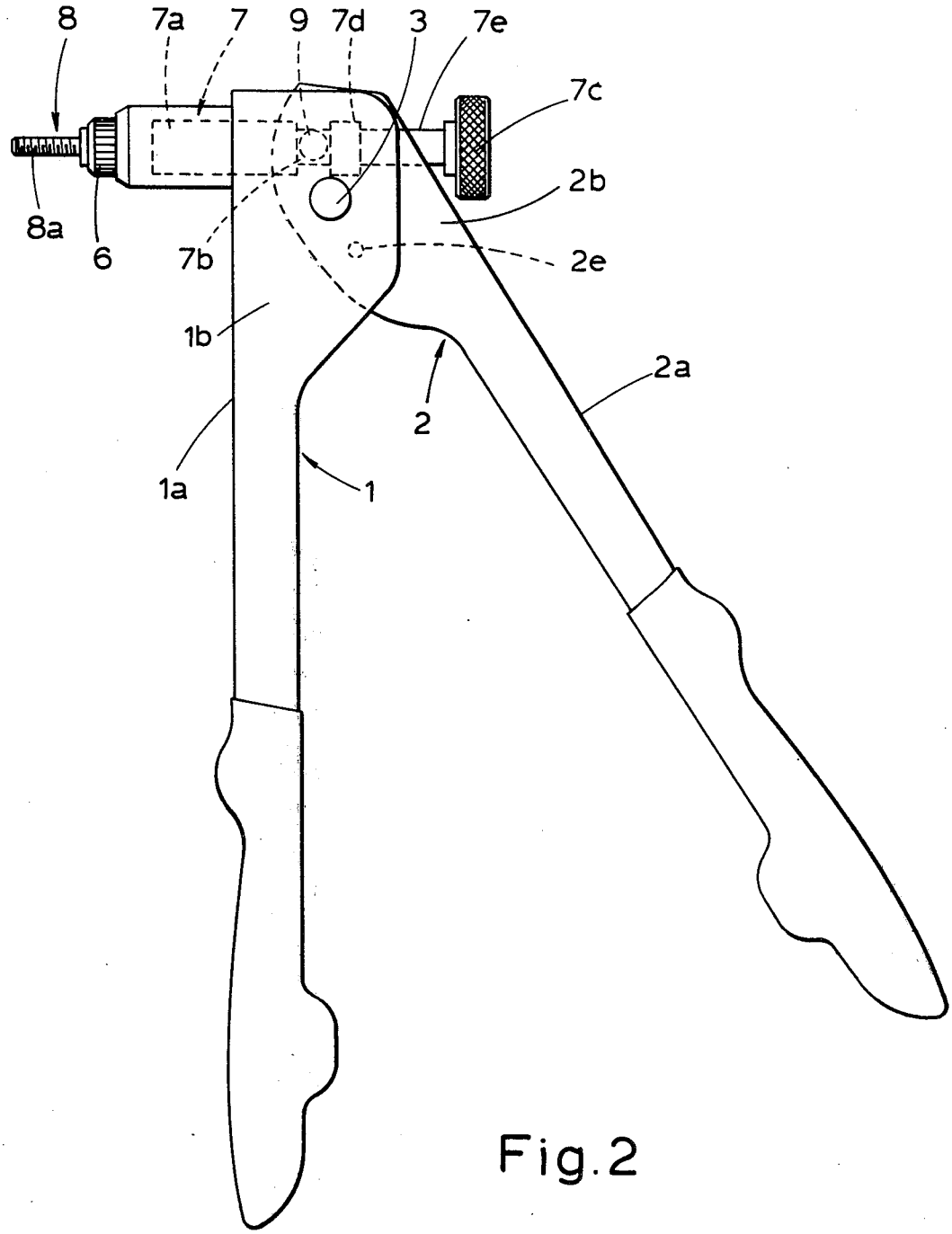
FIG. 2 is a perspective view of the tool.

In use, the correct mandrel 8 for the bush to be set is screwed into the threaded bore in the end face of the mandrel puller 7. The nose bush 6 (which corresponds to the chosen mandrel 8) is then screwed into the nose 5. A threaded bush (not shown) is then threaded onto the thread 8a, the handles 1a and 2a are unclamped and allowed to move into their fully open position (as shown in FIG. 2). The bush is then positioned within an aperture in which it is to be set, and the handles 1a and 2a gripped and pulled together. This causes the pivot plugs 9 to move clockwise (as seen in FIG. 2) about the pivot pin 3, the pivot plugs thus causing the mandrel puller 7 to move to the right. This pulls the mandrel 8 and bush to the right. When the end of the bush strikes the nose bush 6, further movement of the mandrel 8 to the right causes the bush to expand and grip the walls of the aperture. In some cases it may be necessary for the handles 1a and 2a to be re-opened and a second closing action to be carried out in order to set a bush in its aperture. Once set in position, the bush is released from the mandrel 8 by rotating the mandrel puller 7 so as to unthread the mandrel from the set bush. Because of the provision of left-hand threads on the nose bush 6 and beteeen the mandrel 8 and the mandrel puller 7, this action will always unthread the bush from the mandrel rather than unthreading the mandrel from the mandrel puller or the nose bush from the nose 5.

The tool described above can be used with any of the three standard types of threaded bush and so can be used with both thin and thick sheets as well as in blind apertures in materials such as chip board.

I claim:

1. A tool for setting threaded bushes, the tool comprising a body portion, a mandrel puller rotatably and slidably mounted in the body portion, a mandrel fixed, by means of a screw-threaded engagement, to the mandrel puller for rotational and sliding movement therewith, and means for sliding the mandrel relative to the body portion, the free end portion of the mandrel being screw-threaded for engagement with a threaded bush, the threaded bush being settable by sliding the mandrel puller relative to the body portion so that the threaded bush strikes the body portion, is arrested thereby, and is expanded upon further movement of the mandrel puller, and the threaded bush is releasable from the mandrel by rotation of the mandrel puller relative to the body portion, wherein the screw thread at the free end portion of the mandrel is of opposite hand to that fixing the mandrel to the mandrel puller.

2. A tool according to claim 1, wherein that end portion of the mandrel puller opposite to that which is fixed to the mandrel, is formed as a knurled hand grip.

3. A tool according to claim 1, wherein the screw-threaded engagement between the mandrel and the mandrel puller is left-handed.

4. A tool according to claim 1, wherein the body portion has a hollow, generally cylindrical nose into which the mandrel puller is a sliding fit, the mandrel puller also being generally cylindrical.

5. A tool according to claim 4, wherein the nose is provided with a nose bush through which extends the free end portion of the mandrel.

6. A tool according to claim 5, wherein the nose bush is connected to the nose by means of a left-handed screw-threaded engagement.

7. A tool according to claim 1, wherein a lever portion constitutes said means for sliding the mandrel puller relative to the body portion, the lever portion being pivoted to the body portion and being provided with means engaging the mandrel puller.

8. A tool according to claim 7, wherein said means engaging the mandrel puller is constituted by plug means which engage in an annular groove provided in the mandrel puller.

9. A tool according to claim 7, wherein both the body portion and the lever portion are provided with handles.

10. A tool according to claim 9, wherein the two handles are spring biassed apart.

11. In a tool for setting threaded bushes, the tool comprising a body portion, a mandrel puller slidably mounted in the body portion, a mandrel fixed, by means of a screw-threaded engagement, to the mandrel puller for movement therewith, and means for sliding the mandrel puller relative to the body portion, the free end portion of the mandrel extending through the body portion and being screw-threaded for engagement with a threaded bush, the threaded bush being settable by sliding the mandrel puller relative to the body portion so that the threaded bush strikes the body portion, is arrested thereby, and is expanded upon further movement of the mandrel puller, the improvements comprising rotatably mounting the mandrel puller in the body portion so that, when the threaded bush has been set, it is releasable from the mandrel by rotation of the mandrel puller, and arranging the screw thread at the free end portion of the mandrel to be of opposite hand to that fixing the mandrel to the mandrel puller.

12. A tool for setting threaded bushes, the tool comprising a body portion, a mandrel puller rotatably and slidably mounted in the body portion, a mandrel fixed, by means of a screw-threaded engagement, to the mandrel puller for rotational and sliding movement therewith and manually operable means for sliding the mandrel relative to the body portion, the free end portion of the mandrel being screw-threaded for engagement with a threaded bush, the threaded bush being settable by manually operating said means to slide the mandrel puller relative to the body portion so that the threaded bush strikes the body portion, is arrested thereby, and is expanded upon further movement of the mandrel puller, and the threaded bush is releasable from the mandrel by manual rotation of the mandrel puller relative to the body portion, wherein the screw thread at the free end portion of the mandrel is of opposite hand to that fixing the mandrel to the mandrel puller.

* * * * *